US006709266B2

(12) United States Patent
Jensen

(10) Patent No.: US 6,709,266 B2
(45) Date of Patent: Mar. 23, 2004

(54) CANDLE HOLDER AND A METHOD OF SECURING A CANDLE

(76) Inventor: Brian Vang Jensen, Smedevej 18, Nr. Vorupor, DK-7700 Thisted (DK)

( * ) Notice: Subject to any disclaimer, the term of this patent is extended or adjusted under 35 U.S.C. 154(b) by 0 days.

(21) Appl. No.: 10/229,806

(22) Filed: Aug. 28, 2002

(65) Prior Publication Data

US 2003/0064338 A1 Apr. 3, 2003

Related U.S. Application Data

(63) Continuation of application No. PCT/DK01/00138, filed on Mar. 1, 2001.

(30) Foreign Application Priority Data

Mar. 1, 2000 (DK) ..... 2000 0032

(51) Int. Cl.[7] ..... F21V 35/00

(52) U.S. Cl. ..... 431/296; 431/297; 431/120; 30/459; 30/458; 30/453; 30/454

(58) Field of Search ..... 431/297, 120, 431/296, 289; 30/451, 453, 454, 457, 458, 459

(56) References Cited

U.S. PATENT DOCUMENTS

| | | | | | |
|---|---|---|---|---|---|
| 33,788 | A | * | 11/1861 | Marsden et al. | 431/296 |
| 273,103 | A | * | 2/1883 | Keibel | 431/297 |
| 422,989 | A | * | 3/1890 | Stelzner | 431/297 |
| 1,451,163 | A | * | 4/1923 | Hope | 82/128 |
| 1,474,910 | A | * | 11/1923 | Petersen | 431/297 |
| 2,057,943 | A | * | 10/1936 | Friedrichs | 431/297 |
| 2,393,767 | A | * | 1/1946 | Gould | 431/289 |
| 2,691,960 | A | * | 10/1954 | Leeds et al. | 30/454 |
| 2,775,882 | A | * | 1/1957 | Doig | 431/120 |
| 3,242,526 | A | * | 3/1966 | Wilton et al. | 408/211 |
| 3,918,888 | A | * | 11/1975 | Clarke et al. | 431/297 |
| 4,158,912 | A | * | 6/1979 | Erdmann | 30/124 |
| 5,379,817 | A | * | 1/1995 | O'Neil et al. | 144/363 |
| 5,699,620 | A | * | 12/1997 | Hadtke et al. | 30/452 |

FOREIGN PATENT DOCUMENTS

| | | | | |
|---|---|---|---|---|
| DE | 58 793 | * | 9/1891 | |
| DE | 342 408 | * | 10/1921 | |
| DE | 342408 | * | 10/1921 | |
| DE | 19 96 908 | * | 11/1968 | |
| DE | 1 996 908 | * | 11/1968 | |
| DE | 2 324 012 | * | 11/1974 | 431/296 |
| DE | 26 49 255 | * | 5/1978 | 431/297 |
| DE | 41 11 395 | * | 10/1992 | 431/297 |
| DE | 195 18 477 | * | 11/1996 | 431/297 |
| GB | 4990 | * | 3/1910 | |
| WO | WO 01/65173 | * | 9/2001 | 431/297 |

* cited by examiner

*Primary Examiner*—Carl D. Price
(74) *Attorney, Agent, or Firm*—Klein, O'Neill & Singh, LLP

(57) ABSTRACT

A candle holder 1 comprises an annular collar 2 and a bottom disc 3 interconnected by ribs 4 having sharp edges 5 for trimming a candle end inserted in the cavity defined by the ribs 4, the collar 1 and disc 3 while rotating the holder relative to the candle such that the sharpened edges 5 trim the candle end until said end is entirely received in the cavity, resilient arms 11 being provided for ensuring that the holder with candle inserted may be stably secured in the socket of a candlestick.

11 Claims, 2 Drawing Sheets

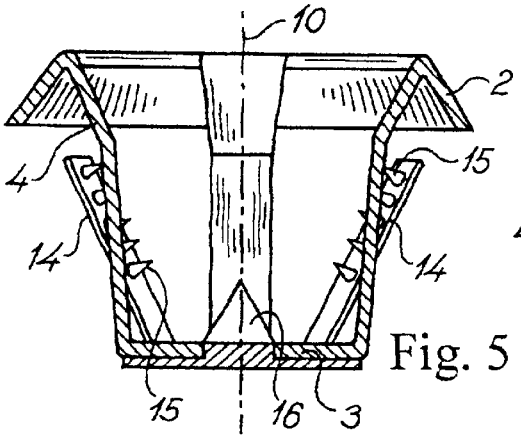
Fig. 5
Fig. 6
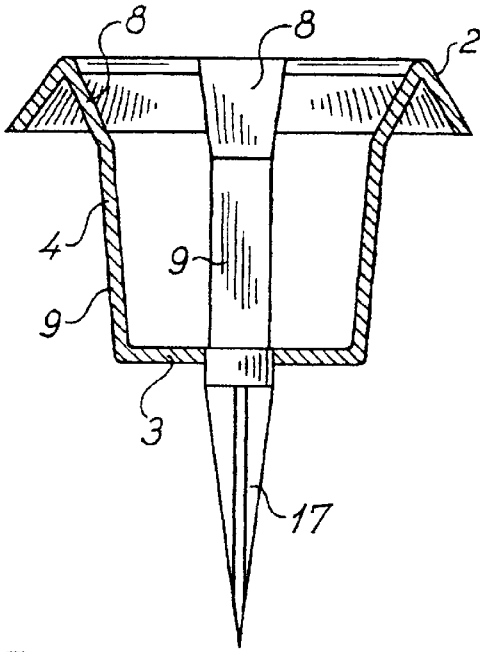
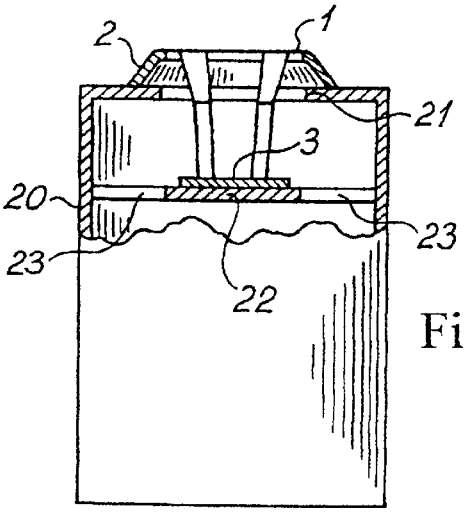
Fig. 7
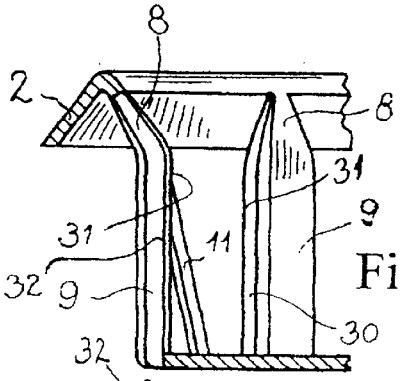
Fig. 9
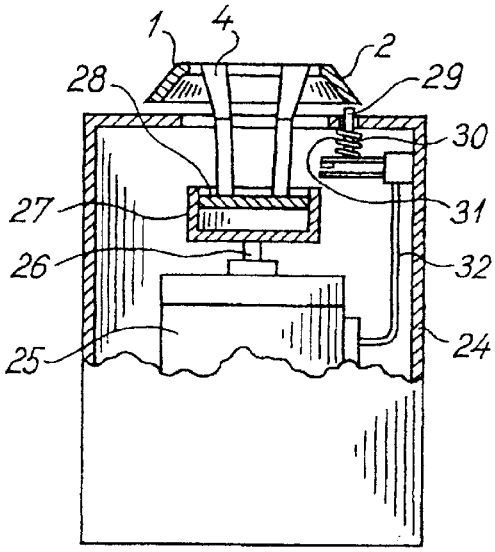
Fig. 8
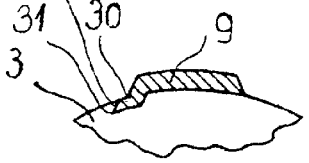
Fig. 10

CANDLE HOLDER AND A METHOD OF SECURING A CANDLE

CROSS-REFERENCE TO RELATED APPLICATION

This application is a Continuation of co-pending International Application No. PCT/DK01/00138; filed Mar. 1, 2001.

BACKGROUND OF THE INVENTION

The present invention relates to a candle holder comprising a body having a cavity adapted for receiving the end of a candle opposite the wick thereof, the cavity comprising one or more sharp cutting edges arranged at the circumference of the cavity facing the interior thereof and adapted for trimming said candle end when inserting the candle end in the cavity while providing for a rotation of the candle relative to the body around the longitudinal axis of the candle.

Such candle trimming holders are known, but they have the disadvantage that they are quite expensive as each candle needs one holder which is used to maintain the candle in upright position on a horizontal surface much in the same way as a candlestick.

A main object of the invention is to provide a candle trimming holder which is relatively inexpensive and easy to use and affords flexibility in the way candles are positioned relative to various objects.

SUMMARY OF THE INVENTION

According to the invention this object is obtained by the body further comprising securing means for allowing the body to be secured in a desired position relative to an object such as a socket of a candlestick or a surface of a home decoration so that the candle holder functions as an adapter device between the candle end and said object.

Hereby the candle holder may be attached to all types of objects providing the securing means are adapted for the specific object relative to which the adapter device or candle holder is to be positioned.

In a currently preferred embodiment of a candle holder according to the invention the body comprises an annular portion and a circular disc mutually co-axially interconnected by one or more sharp edged rib portions each attached at one end thereof to the inner edge of the annular portion and at the opposite end to the outer edge of the circular disc such that a cylindrical cavity is defined thereby for receiving the end of a candle. This is a particularly simple and efficient way of achieving the objects of the invention.

Preferably, the candle holder according to the invention further comprises one or more resilient arms attached to the circular disc and extending outwards relative to the centre of the disc and towards the plane of the annular portion such that insertion of the body in a socket of a candlestick will entail resilient deformation of said arms. Although a resilient frictional engagement between the candle holder and the inside of a socket of a candlestick can be achieved in many ways, for instance ribs or projections protruding from the side of the body, this embodiment is particularly useful and simple.

In connection with tall candles or when it is particularly important that the candle be well secured in the holder it is advantageous that the arms are provided with sharp projections facing the interior of said cavity for engaging the surface of the candle end when the holder with a candle end inserted in the cavity thereof is inserted in a socket of a candlestick.

Advantageously the circular disc may be provided with projections for engaging the end of a candle inserted in the cavity and/or the surface region of an object such as a table or a home decoration, or the circular disc may be provided with one or more apertures for receiving securing means for securing the holder to an object.

In the currently preferred embodiment of candle holder according to the invention each of said one or more rib portions comprises a first substantially rectilinear length extending from said annular portion at a first angle relative to the axis of said annular portion and said circular disc and a second substantially rectangular length extending from said first length at a second angle relative to said axis, said second angle being smaller than said first angle. Hereby, a particularly effective trimming and clamping interaction between the holder and a candle may be achieved.

Preferably, the candle holder according to the invention comprises at least two, preferably four rib portions, the thickness of said rib portions being such relative to the sharpness of the sharp edge of said second length of said rib portions that the candle is held resiliently between said second lengths after trimming of the candle is completed. Hereby a particularly stable connection between the holder and the candle is achieved.

In the currently preferred embodiment of a candle holder according to the invention, said sharp edge is configured as a projecting edge portion of said rib portion having a cutting edge. This is particularly advantageous in case the holder ribs are molded in a plastic material.

In the currently preferred embodiment of a candle holder according to the invention, the cutting angle of the edge portion of said second length is larger than the cutting angle of the edge portion of said first length such that the candle trimming ability of said first length is greater than the candle trimming ability of said second length. Hereby, the candle trimming operation may be performed in a rapid and efficient manner.

In another aspect, the invention relates to a combination of a candle holder and a candlestick or the like having a socket, the candle holder comprising a body having a cavity adapted for receiving the end of a candle opposite the wick thereof, the cavity comprising one or more sharp cutting edges arranged at the circumference of the cavity facing the interior thereof and adapted for trimming said candle end when inserting the candle end in the cavity while providing for a rotation of the candle relative to the body around the longitudinal axis of the candle, the candlestick comprising first securing means associated with said socket, and the candle holder further comprising second securing means cooperating with said first securing means such that said body is secured in a desired position relative to said socket so that the candle holder functions as an adapter device between the candle end and said socket.

In a yet further aspect the invention relates to a combination of a candle holder of the above type and comprising first fixing means and a candle trimming housing comprising a container having an aperture for receiving the candle holder and second fixing means for cooperating with said first fixing means for fixing the candle holder in said aperture.

In a yet further aspect, the invention relates to a combination of a candle holder comprising a body having a cavity adapted for receiving the end of a candle opposite the wick thereof, the cavity comprising one or more sharp cutting edges arranged at the circumference of the cavity facing the interior thereof and adapted for trimming said candle end when inserting the candle end in the cavity while providing for a rotation of the candle relative to the body around the longitudinal axis of the candle, the body being provided with first coupling means, and a candle trimming housing comprising a container having an aperture for receiving the candle holder and enclosing an electric motor connected to second coupling means for cooperating with said first coupling means for rotating the candle holder in said aperture around said longitudinal axis.

Hereby it is obtained that either a great many candles may be trimmed quickly and efficiently at a central location or a great number of candle holders may be applied to the ends of candles quickly and efficiently at a central location. The combination will also allow physically weak persons to apply the principles of the invention by substituting the power of the electrical motor for manual power.

In a final aspect, the invention relates to method of securing a candle in a certain location relative to an object such as a socket of a candlestick or a surface of a home decoration, the method comprising the steps of providing a candle holder comprising a body having a cavity adapted for receiving the end of a candle opposite the wick thereof, the cavity comprising one or more sharp cutting edges arranged at the circumference of the cavity facing the interior thereof and adapted for trimming said candle end when inserting the candle end in the cavity while providing for a rotation of the candle relative to the body around the longitudinal axis of the candle, the body further comprising securing means for allowing the body to be secured in a desired position relative to an object such as a socket of a candle stick or a surface of a home decoration so that the candle holder functions as an adapter device between the candle end and said object, inserting the end of a candle opposite the wick thereof into the cavity while rotating the candle and/or the body around the longitudinal axis of the candle, pressing the candle into the cavity in the direction of said longitudinal axis during said rotation and while the candle end is trimmed by said one or more sharp edges until the candle end is firmly secured in said cavity, and securing said body in said desired position.

BRIEF DESCRIPTION OF THE DRAWING

Various embodiments of a candle holder, combinations and a method according to the invention will be described in the following solely by way of example and with reference to the drawings where:

FIG. 5 is an elevational sectional view of a second embodiment of a candle holder according to the invention, FIG. 6 is an elevational sectional view of a third embodiment of a candle holder according to the invention, FIG. 7 is a partly cut-away view of a holder for the candle holder for collection of material trimmed from the candle end, FIG. 8 is a partly cut-away view of an assembly for automatically rotating a trimming candle holder according to the invention, FIG. 9 is a partly cut-away sectional elevational view of the candle holder of FIGS. 1–3 illustrating the cutting edge portions of the rib portions, and FIG. 10 is a cut-away sectional top view of a rib portion illustrating the cutting edge portions of the rib portions.

Referring now to FIGS. 1 to 4, a candle holder 1 comprises an annular collar 2 and a circular disc 3 connected to the annular collar by means of ribs 4 having sharpened edges 5.

The collar 2, the ribs 4 and the disc 3 define a cavity or socket for receiving the end of a candle 6.

DETAILED DESCRIPTION OF THE INVENTION

Figure 3:
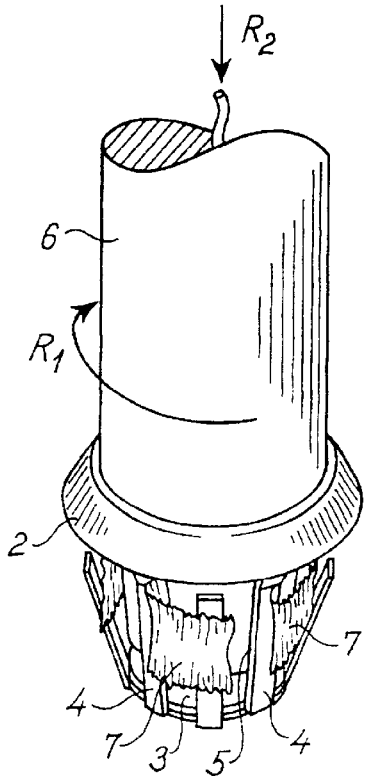
FIG. 3 is an oblique top perspective view of the holder shown in FIGS. 1 and 2 with a candle being inserted therein by a combination of rotation and pressing.

As illustrated in FIG. 3, a candle 6 is inserted in the holder 1 by rotating the candle in the direction of the arrow $R_1$, while at the same time pressing the candle in a direction of the arrow $R_2$ such that the end of the candle 6 is pressed against the ribs 4 whereby shavings 7 are trimmed or shaved off the end of the candle 6 by the sharp edges 5 thus allowing the candle to be moved gradually in the direction of the arrow $R_2$ into the holder 1 until the end of the candle 6 abuts the bottom disc 3 or the candle 6 has been inserted sufficiently for being firmly and securely held in the candle holder 1.

Hereby candles having different diameters may be inserted in the candle holder and be held firmly therein. In FIG. 3 the candle 6 is shown as having the same diameter as the internal diameter of the annular portion 2, but any diameter between the inner diameter of the annular portion 2 and the outer diameter of the bottom disc 3 may be used in connection with the holder 1. That is to say that the diameter of the candle end should be somewhat larger than the outer diameter of the bottom disc 3 so as to achieve a frictional engagement between the ribs 4 and the candle end.

The ribs 4 comprise two portions 8 and 9 extending at angles to the longitudinal axis 10 of the candle holder so that the portions 8 define a frustoconical socket with a first conical angle and the portions 9 define a second frustoconical surface with a second, smaller conical angle.

The collar 2 extends outwards and downwards so that the ribs 4 are substantially hidden from view when the candle is fully inserted in the holder 1.

Figure 1:
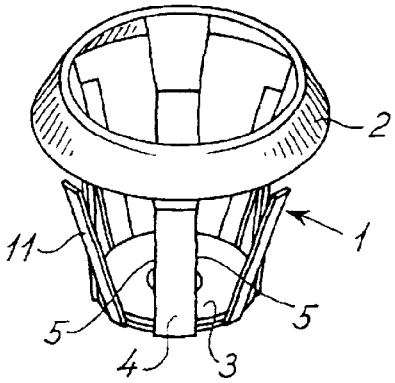
FIG. 1 is a top oblique perspective view of a first embodiment of a candle holder according to the invention.
Figure 2:
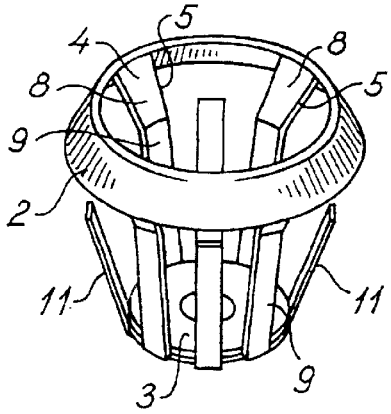
FIG. 2 is a view similar to FIG. 1 but with the holder turned 45° around the longitudinal axis thereof.
Figure 4:
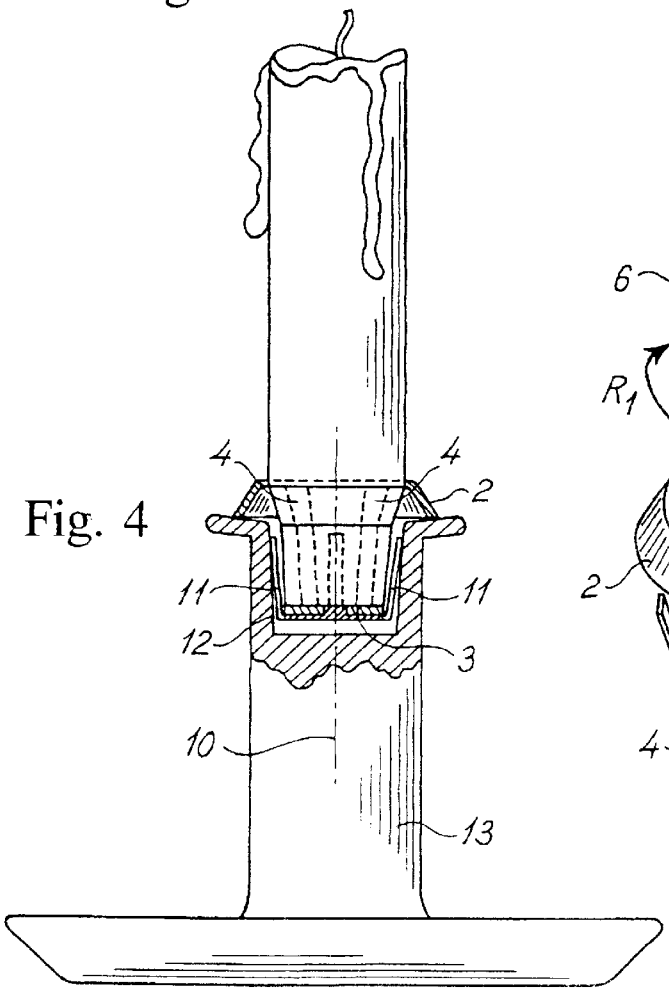
FIG. 4 is an elevational view partly in section of a candlestick having a candle holder as shown in FIGS. 1 to 3 inserted in a socket with a candle inserted in the holder.

The holder 1 is furthermore provided with elastically deformable arms 11 extending from the edge of the bottom disc 3 at an angle to the axis 10. The purpose of the arms 11 is shown in FIG. 4 where the holder 1 has been inserted in a socket 12 of a candlestick 13. The arms 11 are thereby pressed inwards by the walls of the socket and will ensure that a good frictional engagement between the holder 1 and the socket 12 is established, i.e. the arms 11 and the internal wall of the socket 12 function as cooperating securing means to secure the holder 1 and the candle 6 in the socket 12 of the candlestick 13.

Many candlesticks have sockets 12 that are more or less frustoconical, i.e. tapering towards the bottom thereof. Therefore it s advantageous that the cavity or socket defined in the holder by the ribs 4 also is frustoconically tapered towards the bottom disc 3.

It will be clear to those skilled in the art that the sharp edges for trimming the candle can be established in may different ways and that the shape of the holder can be varied in many ways and that further the securing means on the holder to collaborate with the socket of a candlestick can also be varied in many ways.

In FIGS. 9–10, the currently preferred embodiment of the sharp cutting edges are shown which is particularly well-suited for candle holders according to the invention made from a molded plastic material. An edge portion 30 extending along the entire length of the rib 4 is provided with a sharp edge 31 of a beveled portion 32 forming a cutting blade for trimming the candle.

In FIG. 10, the edge portion 30 extending along the portion 8 of the rib 4 is shown projecting inwards relative to the periphery of the disc 3 such that an effective trimming of the candle by the portion 8 may be carried out. The bevel angle of the beveled portion 31 is approx. 45 degrees, i.e. the angle at the edge 31 is 45 degrees.

As regards the corresponding angle at the edge 31 along the portion 9, said angle is more obtuse, namely 60–65 degrees such that a thicker layer is cut off the candle by this more aggressive cutting edge which facilitates the trimming of the candle, which is particularly useful if the candle has a diameter nearly equal to the interior diameter of the collar 2.

As an example, a useful combination is that the interior diameter of the collar 2 is 25.5 mm, i.e. a maximum diameter of the candle end of 25.5 mm. The diameter of the circle defined by the ribs 4 at the junction between portions 8 and 9 thereof is 17.5 mm, i.e. a maximum of 8 mm is trimmed off the diameter of a candle end by the cutting edges 31 of the portions 8. The diameter of the circle defined by the end of the portions 9 adjacent the disc 3 is 16.0 mm, i.e. 1.5 mm is trimmed of the diameter of the candle by the cutting edges 31 of the portions 9.

It is preferable that the stiffness of the ribs 4 be chosen such relative to the sharpness of the cutting edges 5 that the ribs resiliently press against the outer surface of the candle end after completion of trimming such that the candle holder 1 is retained on the end of the candle and the candle is stable in the holder when the holder is for instance inserted in the socket of a candlestick.

Referring now to FIG. 5, a second embodiment of a candle holder according to the invention is shown having the same annular collar or portion 2 and bottom portion or disc 3 as well as ribs 4 as in the first embodiment shown in FIGS. 1 to 4. However, this embodiment is provided with arms 14 similar to the arms 11 in FIGS. 1 to 4, but provided with sharpened projections 15 for engaging the candle end when the holder 1 is inserted in the socket 12 of a candlestick 13 and the arms 14 thereby are pressed inwards towards the axis 10 of the holder 1, thereby ensuring an even more secure fixation of the candle in the holder. The bottom disc 3 is furthermore provided with a pointed central projection 16 for engaging and penetrating the bottom of the end of a candle for additional security in the fixation of the candle in the holder.

Referring now to FIG. 6, a third embodiment of a candle holder according to the invention is shown. The third embodiment is similar to the embodiments dealt with before but does not have arms for engaging the interior surface of a candlestick socket but is provided with a sharp projection 17 for securing the candle holder in an object by pressing the projection 17 into the object that can be a Christmas decoration, a cushion or any other object that can be penetrated by the projection 17 and support the projection to a degree sufficient to maintain the holder with a candle therein in an upright position.

It will be obvious to those skilled in the art that many other types of securing means may be adopted for securing the candle holder relative to an object. For instance the bottom disc 3 may be a magnet for securing the holder to an iron object or the bottom surface of the disc may be one part of a Velcro™ fastener where the other part of the Velcro fastener is arranged on the object to which the candle holder is to be attached. The bottom disc may be supplied with a threaded aperture for collaboration with a threaded pin on an object or a surface, or the disc may be provided with a threaded pin for being threaded into a threaded aperture in the object to which the candle holder is to be secured.

The candle holder according to the invention can be produced and sold in different sizes and materials and the bottom disc 3 may be provided with apertures 4 for receiving leg means for supporting the candle holder on the surface of a table in which case the candle holder according to the invention will function in the same way as a candlestick.

Referring now to FIG. 7, a candle holder 1, e.g. as shown in FIGS. 1 to 4, is arranged inside a trimming holder 20 by being inserted through an aperture 21 in the top of the holder 20 and supported on a platform 22 inside the holder 20 and also supported by abutment of the annular collar 2 on the top surface of the holder 20 around the aperture 21. Around the platform 22 apertures 23 are distributed for allowing trimmings or shavings from a candle rotated in the holder 1 while the holder 1 is arranged in the holder 20 to be received in the bottom part of the holder 20 so that the trimmings may be collected for later disposal. The bottom disc 3 of the candle holder 1 may have apertures, not shown, for receiving pins, not shown, attached to the platform 22 so that the holder 1 is fixated against rotation relative to the holder 20 and a candle can be rotated in the candle holder 1 for being trimmed while the necessary reaction to the rotation force is exerted on the surface of the holder 20 which can be more comfortable and easy to control.

The platform 22 may be attached in any suitable manner to the inside wall of the holder 20.

Referring now to FIG. 8, an automatic device for rotating a candle holder 1 according to the invention is shown in an elevational view partly in section. A housing 24 encloses an electrical motor 25 driven by a battery (not shown) and having its output shaft 26 connected to a cylinder-like holder 27 in which the bottom portion 28 of a candle holder 1 is received in a manner allowing the portion 28 to move piston-like up and down in the cylinder-like holder 27. The collar 2 of the candle holder abuts an actuator pin 29 biased by a spring 30 and connected to a contact arm 31 for starting and stopping the electrical motor 25 by means of electrical connector 32.

In use, a candle is inserted into the cavity defined by the ribs 4 and the candle is pressed downward so that the collar 2 depresses the pin 29 so that the contact arm 30 starts the electromotor 25 whereby the candle holder 1 is rotated thereby trimming the candle which finally can be removed after being sufficiently trimmed and thereafter can be inserted in another candle holder having the same or similar dimensions as the holder rotated by the electromotor 25, particularly as regards the cavity defined by the ribs 4.

Hereby candles can be trimmed centrally, e.g. in the kitchen, and the trimmed candles can then be transferred and inserted into similar candle holders for being arranged in sockets of candlesticks or otherwise as desired. The container 24 should obviously have a removable bottom or the like so as to enable emptying out the candle trimmings which will fall into the container 24 around the electromotor.

The removable bottom may also be used for exchanging batteries for the electromotor 25.

The automatic candle trimming device 24 may also be adapted such that each candle holder may be inserted and releasably gripped by corresponding pin/aperture engagement or the like such that the individual candle holders are releasably inserted in the automatic trimming device and the candles do not have to be removed from the candle holder but are transferred with each its own candle holder to the end use desired.

The candle holder according to the invention may be described as for use in fixating a candle in a candlestick, the candle holder having a body with a central cavity configured as a generally cylindrical cavity and adapted to receive an end portion of a candle, the cavity in its circumference having a number of longitudinally extending slits with preferably sharp edge portions adapted to, when rotating the candle end relative to the candle holder as in a pencil sharpener, peel material from the candle end, until the candle end fits in the cavity, the candle holder in its entirety being adapted to be received in the cavity or socket of a standard candlestick.

The central cavity of the candle holder may be funnel-shaped, i.e. the longitudinal slits are oblique with respect to longitudinal axis of the cavity.

The central cavity may have an oblique outer surface extending in two or more steps with an outer funnel shape having a larger degree of taper with regard to the longitudinal axis of the cavity and an inner funnel shape with a smaller angle of taper in relation to said longitudinal axis.

The candle holder may comprise a number of exterior securing means adapted to engage the inner surface of a usual socket in a candlestick.

The securing means may be arranged at the inner end of the candle holder and preferably in register with the longitudinal slits.

The central cavity may at the outer end thereof be surrounded by a collar portion extending obliquely outwards and downwards and adapted to hide the end portions of said longitudinal slits when the candle holder is viewed from above.

The central cavity may be delimited towards the inner portion thereof by a circular bottom plate having a central aperture adapted to receive a securing projection for allowing the candle holder to be attached to a surface of a home decoration such as a Christmas decoration or the like.

The bottom plate may also comprise a number of securing apertures adapted to collaborate with projections in a housing such that the candle holder may be arranged in said housing for collection of the peeled-off candle material.

The bottom plate may also comprise a number of other securing apertures for use when securing the candle holder to a home decoration by means of wire, string or the like.

The candle holder may preferably be manufactured by injection moulding from a suitable plastic material or it may be manufactured from a suitable metal such as bronze, stainless steel or silver. It may also be manufactured from a combination of a plastic and metal material, e.g. the collar 2 in FIG. 1 of a plastic material and the ribs 4 and disc 3 of a metal material.

What is claimed is:

1. A candle holder comprising a body having an annular portion and a circular disc mutually co-axially interconnected by at least one rib portion provided with a sharp edge and attached one end to an inner edge of the annular portion and at the opposite end to an outer edge of the circular disc such that a cylindrical cavity is defined thereby for receiving an end of a candle;

the cylindrical cavity comprising at least one sharp cuffing edge arranged at an outer circumference of the cylindrical cavity facing an interior thereof and adapted for trimming an end of a candle inserted in the cylindrical cavity while providing for a rotation of an end of a candle relative to the body around the body further comprising securing means for allowing the body to be secured in a desired position relative to an object so that the candle holder functions as an adapter device between an end of a candle and said object; and at least one resilient arm attached to the circular disc and extending outwardly relative to a center of the circular disc and towards a plane of an annular portion such that insertion of the body in a socket of a candlestick will entail resilient deformation of said at least one arm.

2. A candle holder according to claim 1 wherein said at least one resilient arm is provided with at least one sharp projection facing the interior of said cavity for engaging the surface of an end of a candle when the holder with an end of a candle inserted in the cavity thereof is inserted in a socket of a candlestick.

3. A candle holder according to claim 1, wherein the circular disc is provided with at least one projection for engaging an end of a candle inserted in the cavity or the surface region of an object.

4. A candle holder according to claim 1, wherein the circular disc is provided with at least one aperture for receiving securing means for securing the candle holder to an object.

5. A candle holder according to claim 1, wherein said candle holder is made from a plastic material.

6. A candle holder according to claim 1, wherein said at least one rib portion comprises a first length extending from said annular portion of at a first angle relative to an axis of said annular portion and said circular disc and a second length extending from said first length at a second angle relative to said axis, said second angle being smaller than first said first angle.

7. A candle holder according to claim 6, wherein said candle holder comprises at least two rib portions, the thickness of said at least two rib portions being such relative to the sharpness of the sharp edge of said second length of said at least two rib portions that an end of a candle will be held resiliently between said second lengths after trimming of an end of a candle will be held resiliently between said second lengths after trimming of an end of a candle is completed.

8. A candle holder according to claim 6, wherein a cutting angle of the at least one sharp edge of said second length is larger than a cutting angle of the at least one sharp edge of said first length such that the candle trimming ability of said first length is greater than the candle trimming ability of said second length.

9. A candle holder according to claim 1, wherein said at least one sharp edge is configured as a projecting edge portion of said at least one rib portion.

10. A method of securing a candle having a wick and an end opposite the wick in a certain location relative to an object such as a socket of a candlestick or a surface of a home decoration, the method comprising the steps of:

providing a candle holder according to claim 1, inserting the end of the candle opposite the wick thereof into the cavity while rotating the candle and/or the body around the longitudinal axis of the candle, pressing the candle into the cavity in the direction of said longitudinal axis during said rotation and while the candle end opposite the wick is trimmed by said at least one sharp cutting edge until the candle end opposite the wick is firmly secured in the cavity, and securing said body in said desired position.

11. A candle holder comprising a body having an annular portion and a circular disc mutually co-axially interconnected by at least one rib portion provided with a sharp edge and attached at one end to an inner edge of the annular portion and at the opposite end to an outer edge of the circular disc such that a cylindrical cavity is defined thereby for receiving an end of a candle;

the cylindrical cavity comprising at least one sharp cutting edge arranged at an outer circumference of the cylindrical cavity facing an interior thereof and adapted for trimming an end of a candle when inserted in the cylindrical cavity while providing for a rotation of an end of candle relative to the body;

the body further comprising securing means for allowing the body to be secured in a desired position relative to an object so that the candle holder functions as an adapter device between an end of candle and said object;

the at least one rib portion comprising a first length extending from said annular portion at a first angle relative to an axis of said annular portion and said circular disc and a second length extending from said first length at a second angle relative to said axis, said second angle being smaller than said first angle; and wherein said second length has a sharp edge portion with a cutting angle that is larger than a cutting angle of a sharp edge portion of said first length such that the candle trimming ability of said first length is greater than the candle trimming ability of said second length.

* * * * *

UNITED STATES PATENT AND TRADEMARK OFFICE

CERTIFICATE OF CORRECTION

PATENT NO. : 6,709,266 B2
DATED : March 23, 2004
INVENTOR(S) : Brian Vang Jensen It is certified that error appears in the above-identified patent and that said Letters Patent is hereby corrected as shown below:

Column 8,
Line 4, “cuffing” should read as -- cutting --.

Signed and Sealed this

First Day of June, 2004

JON W. DUDAS
*Acting Director of the United States Patent and Trademark Office*